US012359896B2

(12) United States Patent
Eitschberger et al.

(10) Patent No.: US 12,359,896 B2
(45) Date of Patent: Jul. 15, 2025

(54) DETONATOR INCLUDING A MULTIDIMENSIONAL CIRCUIT BOARD

(71) Applicant: DynaEnergetics Europe GmbH, Troisdorf (DE)

(72) Inventors: Christian Eitschberger, Munich (DE); Sascha Thieltges, Siegburg (DE); Andreas Robert Zemla, Much (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 85 days.

(21) Appl. No.: 18/358,483

(22) Filed: Jul. 25, 2023

(65) Prior Publication Data

US 2024/0035784 A1 Feb. 1, 2024

Related U.S. Application Data

(60) Provisional application No. 63/478,417, filed on Jan. 4, 2023, provisional application No. 63/393,385, filed on Jul. 29, 2022.

(51) Int. Cl.
*F42B 3/12* (2006.01)
*F42B 3/192* (2006.01)

(52) U.S. Cl.
CPC ..... *F42B 3/121* (2013.01); *F42B 3/192* (2013.01)

(58) Field of Classification Search
CPC .. F42B 39/30; F42B 3/09; F42B 3/121; F42B 3/192; F42D 1/05; F42D 1/043; E21B 43/1185
See application file for complete search history.

(56) References Cited

U.S. PATENT DOCUMENTS

| | | | |
|---|---|---|---|
| 2,252,270 | A | 8/1941 | Miller |
| 2,934,625 | A | 4/1960 | Patrichi |
| 3,010,396 | A | 11/1961 | Coleman |
| 3,173,992 | A | 3/1965 | Boop |
| 3,208,378 | A | 9/1965 | Boop |
| 3,246,707 | A | 4/1966 | Bell |
| 3,302,269 | A | 2/1967 | Cooper et al. |
| 3,327,792 | A | 6/1967 | Boop |
| 3,474,198 | A | 10/1969 | Conrad |
| 3,648,785 | A | 3/1972 | Walker |

(Continued)

FOREIGN PATENT DOCUMENTS

| | | |
|---|---|---|
| CA | 3038451 A1 | 3/2018 |
| CN | 201218089 | 4/2009 |

(Continued)

OTHER PUBLICATIONS

Albert, Larry et al.; New Perforating Switch Technology Advances Safety & Reliability for Horizontal Completions; HydraFrac 2015-3851; Mar. 17-19, 2015; 16 pgs.

(Continued)

*Primary Examiner* — Joshua E Freeman
(74) *Attorney, Agent, or Firm* — Womble Bond Dickinson (US) LLP

(57) ABSTRACT

A detonator includes a detonating capsule, a detonator head storing an electronic circuit board, and a retaining arm configured to fix the detonating capsule to the detonator head. The electronic circuit board is a multidimensional circuit board that extends from the detonator head into engagement with the detonating capsule.

19 Claims, 16 Drawing Sheets

(56) References Cited

U.S. PATENT DOCUMENTS 4,007,796 A 2/1977 Boop
4,100,978 A 7/1978 Boop
4,234,768 A 11/1980 Boop
4,246,457 A 1/1981 Teichert et al.
4,266,613 A 5/1981 Boop
4,339,638 A 7/1982 Lascelles et al.
4,457,383 A 7/1984 Boop
4,598,776 A 7/1986 Stout
4,637,131 A 1/1987 Ochsner
4,763,519 A 8/1988 Comeau
4,815,382 A * 3/1989 Yunan ..... C06C 5/06 102/275.12
5,027,708 A 7/1991 Gonzalez et al.
5,237,136 A 8/1993 Langston
5,316,087 A 5/1994 Manke et al.
5,347,929 A 9/1994 Lerche et al.
5,483,895 A 1/1996 Tomek et al.
5,499,581 A * 3/1996 Sutula, Jr. ..... F42D 1/043 102/275.12
5,703,320 A * 12/1997 Lucca ..... F42D 1/043 102/275.12
5,780,764 A 7/1998 Welch et al.
5,792,975 A * 8/1998 Tseka ..... C06C 5/06 102/275.12
5,908,365 A 6/1999 LaJaunie et al.
6,095,258 A 8/2000 Reese et al.
6,681,701 B2 * 1/2004 Perry ..... F42D 1/043 102/275.7
7,360,487 B2 4/2008 Myers, Jr. et al.
7,364,451 B2 4/2008 Ring et al.
7,461,580 B2 12/2008 Bell et al.
7,902,469 B2 3/2011 Hurst
8,369,063 B2 2/2013 Vicente
8,387,533 B2 3/2013 Runkel
8,704,524 B2 4/2014 Jones et al.
8,710,385 B2 4/2014 Sickels
8,875,787 B2 11/2014 Tassaroli
8,875,796 B2 11/2014 Hales et al.
8,967,291 B2 3/2015 Bonavides et al.
8,973,675 B2 3/2015 Herrera
8,978,817 B2 3/2015 Rodgers et al.
9,080,433 B2 7/2015 Lanclos et al.
9,145,764 B2 9/2015 Burton et al.
9,194,219 B1 11/2015 Hardesty et al.
9,291,040 B1 3/2016 Hardesty et al.
9,334,715 B2 5/2016 Bonavides et al.
9,347,755 B2 5/2016 Backhus et al.
9,598,951 B2 3/2017 Mueller et al.
9,752,421 B2 9/2017 LaGrange et al.
9,890,620 B2 2/2018 Maxted et al.
10,161,733 B2 12/2018 Eitschberger et al.
10,180,050 B2 1/2019 Hardesty
10,845,178 B2 11/2020 Eitschberger et al.
11,047,216 B2 6/2021 Hardesty et al.
11,391,126 B2 7/2022 Dyess et al.
11,486,234 B2 * 11/2022 MacGillivray ..... H05K 5/0247
11,629,579 B2 * 4/2023 Davis ..... E21B 43/116 166/297
11,719,523 B2 * 8/2023 Saltarelli ..... E21B 43/1185 89/1.151
2002/0100388 A1 * 8/2002 Perry ..... F42D 1/043 102/275.7
2003/0084812 A1 * 5/2003 Perry ..... C06C 5/06 102/275.7
2004/0216632 A1 * 11/2004 Finsterwald ..... F42D 1/043 102/275.12
2005/0016409 A1 * 1/2005 Husk ..... F42D 1/043 102/275.7
2009/0272529 A1 11/2009 Crawford
2009/0301723 A1 12/2009 Gray
2010/0051440 A1 3/2010 Hurst
2010/0085210 A1 4/2010 Bonavides et al.
2010/0208408 A1 8/2010 Love et al.
2010/0265063 A1 10/2010 Eken
2010/0286800 A1 11/2010 Lerche et al.
2012/0199352 A1 8/2012 Lanclos et al.
2012/0247769 A1 10/2012 Schacherer et al.
2012/0250208 A1 10/2012 Love et al.
2012/0255842 A1 10/2012 Runkel
2013/0043074 A1 2/2013 Tassaroli
2013/0104764 A1 5/2013 Metcalfe et al.
2013/0126237 A1 5/2013 Burton et al.
2013/0199843 A1 8/2013 Ross
2013/0291751 A1 11/2013 Sickels
2013/0327514 A1 12/2013 Bonavides et al.
2014/0083718 A1 3/2014 Bell
2014/0260591 A1 9/2014 Rodgers et al.
2015/0000509 A1 1/2015 Current et al.
2016/0070554 A1 3/2016 Lewis et al.
2016/0215597 A1 7/2016 LaGrange et al.
2016/0237794 A1 8/2016 Maxted et al.
2016/0245055 A1 8/2016 Hardesty et al.
2016/0273902 A1 9/2016 Eitschberger
2016/0333676 A1 11/2016 Hardesty
2016/0376879 A1 * 12/2016 Goodman ..... E21B 43/11855 175/4.57
2017/0009560 A1 1/2017 Wells
2018/0135389 A1 5/2018 Sullivan
2018/0299239 A1 10/2018 Eitschberger et al.
2018/0313194 A1 11/2018 Hardesty et al.
2019/0212118 A1 * 7/2019 Saltarelli ..... E21B 43/1185
2019/0309609 A1 10/2019 Hardesty et al.
2020/0018139 A1 * 1/2020 Eitschberger ..... E21B 43/1185
2020/0018584 A1 * 1/2020 Phelps ..... E21B 43/1185
2020/0063537 A1 2/2020 Langford et al.
2020/0225014 A1 7/2020 Maxted et al.
2020/0332630 A1 * 10/2020 Davis ..... E21B 43/11855
2021/0164331 A1 * 6/2021 Sokolove ..... F42B 3/121
2021/0172298 A1 * 6/2021 Knight ..... E21B 43/116
2021/0230986 A1 * 7/2021 Macgillivray ..... H05K 1/0216
2021/0362815 A1 * 11/2021 Wistedt ..... F42D 5/04
2022/0018227 A1 * 1/2022 Kash ..... E21B 43/117
2022/0136813 A1 5/2022 Parasram
2022/0333467 A1 * 10/2022 Eitschberger ..... E21B 33/068

FOREIGN PATENT DOCUMENTS

CN 202141073 U 2/2012
CN 104481469 A 4/2015
CN 205036356 U 2/2016
CN 205400694 U 7/2016
EP 0257155 B1 1/1991
GB 2544247 A 5/2017
JP 2019066093 A 4/2019
RU 2287669 C2 11/2006
WO 2016133550 A1 8/2016
WO 2018022200 A1 2/2018

OTHER PUBLICATIONS

Albert, Larry et al.; New Perforating Switch Technology Advances Safety & Reliability for Horizontal Completions; Unconventional Resources Tech. Conference; Jul. 20-22, 2015; 7 pgs.
Allied Horizontal; Advancing Plug-and-Perf Safety and Reliability; Jul. 2015; 2 pgs; http://alliedhorizontal.com/wireline-services/perforating-services/.
Dynaenergetics, DynaSelect System, Jul. 2016, 6 pages http://www.dynaenergetics.com/uploads/files/56e6f94760245_Product_Brochures_DynaSelect_OnlineView.pdf.
Federal Institute for Industrial Property; Inquiry for RU App No. 2019136666/03(072399); Jun. 17, 2020; 7 pages (English translation 5 pages).
Guardian; Select Fire Switch; May 20, 2015; 2 pgs.; http://www.ggtg.net/guardian-product.php?prod=SFS&prodid=79&cat=bds.
Hunting; Control Fire; Jun. 2013; 20 pgs.; http://www.hunting-intl.com/.
Hunting; EBFire Guide Book; Jan. 28, 2015; 23 pgs; http://www.hunting-intl.com/media/361239/ebfire_guide_book.pdf.
International Searching Authority; International Search Report and Written Opinion for PCT App No. PCT/EP2018/059531; Sep. 19, 2018; 14 pages.

(56) References Cited

OTHER PUBLICATIONS

Longe, Kevin; Boom Times; Winter 2016 DynaEnergetics brochure; Nov. 21, 2016; 3 pgs.
United States Patent and Trademark Office; Non-final Office Action for U.S. Appl. No. 16/194,440, filed Mar. 3, 2020; 10 pages.
United States Patent and Trademark Office; Notice of Allowance for U.S. Appl. No. 16/194,440, filed Jul. 21, 2020; 5 pages.
USPTO, Notice of Allowance for U.S. Appl. No. 15/950,453, mailed Oct. 4, 2018, 7 pgs.
Oilfield Review; "Perforating Innovations - Shooting Holes in Performance Models"; Autumn 2014: 26, No. 3; https://perforators.org/wp-content/uploads/2017/02/2_Shooting-holes-in-Performance-Models.pdf.
Canadian Intellectual Property Office; Office Action for CA Application No. 3058827; issued on Dec. 16, 2020; 5 pages.
The State Intellectual Property Office of P.R. China; Office Action for CN Application No. 201880025701 dated Feb. 2, 2021, 10 pages.
Canadian Intellectual Property Office; Notice of Allowance for CA Application No. 3,058,827; dated May 28, 2021; 1 page.
United States Patent and Trademark Office; Non-Final Office Action for U.S. Appl. No. 16/449,519; dated Jan. 19, 2021; 20 pages.
United States Patent and Trademark Office; Notice of Allowance for U.S. Appl. No. 16/449,519; dated Mar. 8, 2021; 8 pages.
China National Intellectual Property Administration; Office Action for CN Application No. 201880025701.7 dated Sep. 27, 2021; 3 pages.

* cited by examiner

DETONATOR INCLUDING A MULTIDIMENSIONAL CIRCUIT BOARD

CROSS-REFERENCE TO RELATED APPLICATION

This application claims the benefit of and priority to U.S. Provisional Patent Application No. 63/478,417 filed Jan. 4, 2023 and U.S. Provisional Patent Application No. 63/393,385 filed Jul. 29, 2022, the entire contents of which are incorporated by reference herein.

BACKGROUND OF THE DISCLOSURE

A variety of industrial sectors utilize explosives for civil uses. Those industrial sectors include, for example, mining, oil and gas exploration and production, seismic exploration, demolition, and explosive welding. In general, any explosive utilized in these applications is typically initiated using a detonator. Typical detonator designs include a monolithic detonator housing or capsule that houses an explosive load that may include a primary explosive load and a secondary explosive load. During production of the detonator, the primary and secondary explosive loads may be deposited into the detonator capsule.

An initiation device (e.g. fuse head, bridge wire, slapper foil) and electric wiring connected to the initiation device is used to initiate the explosive load. In some fields of application, the detonator may also include some additional electric or electronic parts, for example, resistors or capacitors and other electronic components. Other detonators may include logic circuits, data processors, capacitors, resistors or even measuring devices for example accelerometers, gravimeters, or thermometers, which are typically mounted to an electronic circuit board. With an increased amount of electronics in the detonator, the space on a single electronic circuit board is limited to the outer dimensions of a detonator. This capsule may couple with a second housing, which may include the electric (or electronic) parts and the fuse head. These parts may be stored inside the detonator capsule or they may be stored in another housing that houses both the detonator capsule and the electronic parts and the fuse head. The parts may be permanently connected to each other (e.g. by gluing, crimping, welding, screwing, or through the use of clips or a snap fit connection). The detonator receives a signal to initiate, and detonates with an emerging shock wave. The shock wave initiates the explosive for the application.

For example, hydrocarbons, such as fossil fuels (e.g. oil) and natural gas, are extracted from underground wellbores extending deep below the surface using complex machinery and explosive devices. Once the wellbore is established by placement of casing pipes after drilling and cementing the casing pipe in place, a perforating gun assembly, or train or string of multiple perforating gun assemblies, are lowered into the wellbore, and positioned adjacent one or more hydrocarbon reservoirs in underground formations. The detonator is then used to initiate one or more shaped charges positioned in the perforating gun assembly.

BRIEF DESCRIPTION

According to an aspect, the exemplary embodiments include a detonator including a housing, a first printed circuit board supported in the housing, an appendage extending from the housing, and a detonating capsule configured for receipt in a channel defined by the appendage. The appendage has a tab and the detonating capsule defines an opening configured to be selectively engaged by the tab to retain the detonating capsule in the channel of the appendage.

According to another aspect, the exemplary embodiments include a detonator including a housing defining an inner chamber, a printed circuit board supported in the inner chamber of the housing, an appendage, and a detonating capsule. The appendage has a body portion extending from the housing, a retaining arm having a proximal end portion movably coupled to the body portion, and a tab extending from a free, distal end portion of the retaining arm. The detonating capsule is configured for receipt in a longitudinally-extending channel defined by the body portion. The detonating capsule defines an opening configured to be selectively engaged by the tab to retain the detonating capsule in the channel of the body portion.

According to yet another aspect, the exemplary embodiments include a detonator including a housing, a printed circuit board, a body portion extending from the housing, and a retaining arm. The printed circuit board includes a first portion supported in the housing, and a second portion extending from the first portion of the printed circuit board. The body portion defines a longitudinally-extending channel configured for receipt of a detonating capsule. The retaining arm includes a proximal end portion movably coupled to the body portion, and a free, distal end portion having a tab. The tab is configured for receipt in an opening of a detonating capsule.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
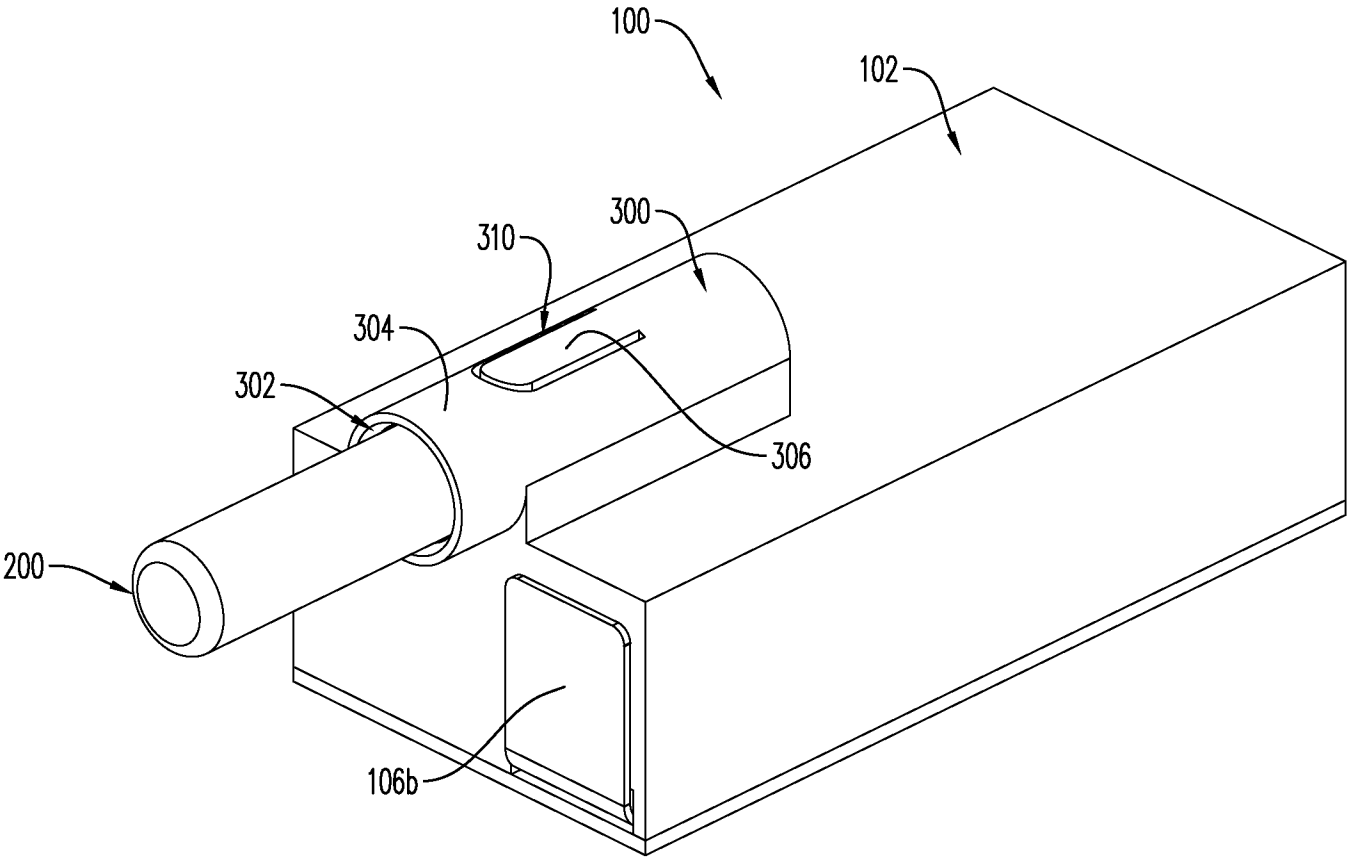
FIG. 1 is a perspective view of a detonator including a detonator housing and a detonating capsule attached to the detonator housing.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

For purposes of illustrating features of the embodiments, an exemplary embodiment will now be introduced and referenced throughout the disclosure. This example is illustrative and not limiting and is provided for illustrating the exemplary features of a detonator and components thereof as described throughout this disclosure.

Detonators can be designed to have simple electric components inside, like wires and resistors, or have complex electronic components inside. These more complex electronic detonators may include logic circuits, data processors, capacitors, resistors or even measuring devices, such as, for example, accelerometers, gravimeters, or thermometers. These complex electronic systems are typically mounted to an electronic circuit board. With an increased amount of electronics in the detonator, the space on a single electronic circuit board is limited to the outer dimensions of a detonator.

Accordingly, the present disclosure provides a detonator with a multidimensional electronics circuit board to store more complex electronics into a detonator housing. Further, the present disclosure provides a mechanism for easily coupling a detonator capsule to the multidimensional electronics circuit board.

FIG. 1 shows an exemplary embodiment of a detonator 100 used to initiate one or more shaped charges positioned in a perforating gun assembly (not explicitly shown). The detonator 100 generally includes a detonator head or detonator housing 102 and a detonating capsule 200 configured to be coupled to the detonator housing 102. The detonator housing 102 is illustrated as a generally rectangular structure, however, other shapes are contemplated. The detonator housing 102 may be made of metal, plastics, (injection molded, 3D printed), or any other suitable material. The detonator housing 102 defines an inner chamber 140 within which a multidimensional printed circuit board 130 is received. The electronic printed circuit board 130 is configured to initiate a fuse head 112 (FIG. 2*a*) of the detonating capsule 200 with an electric current signal, as will be described.

Figure 2A:
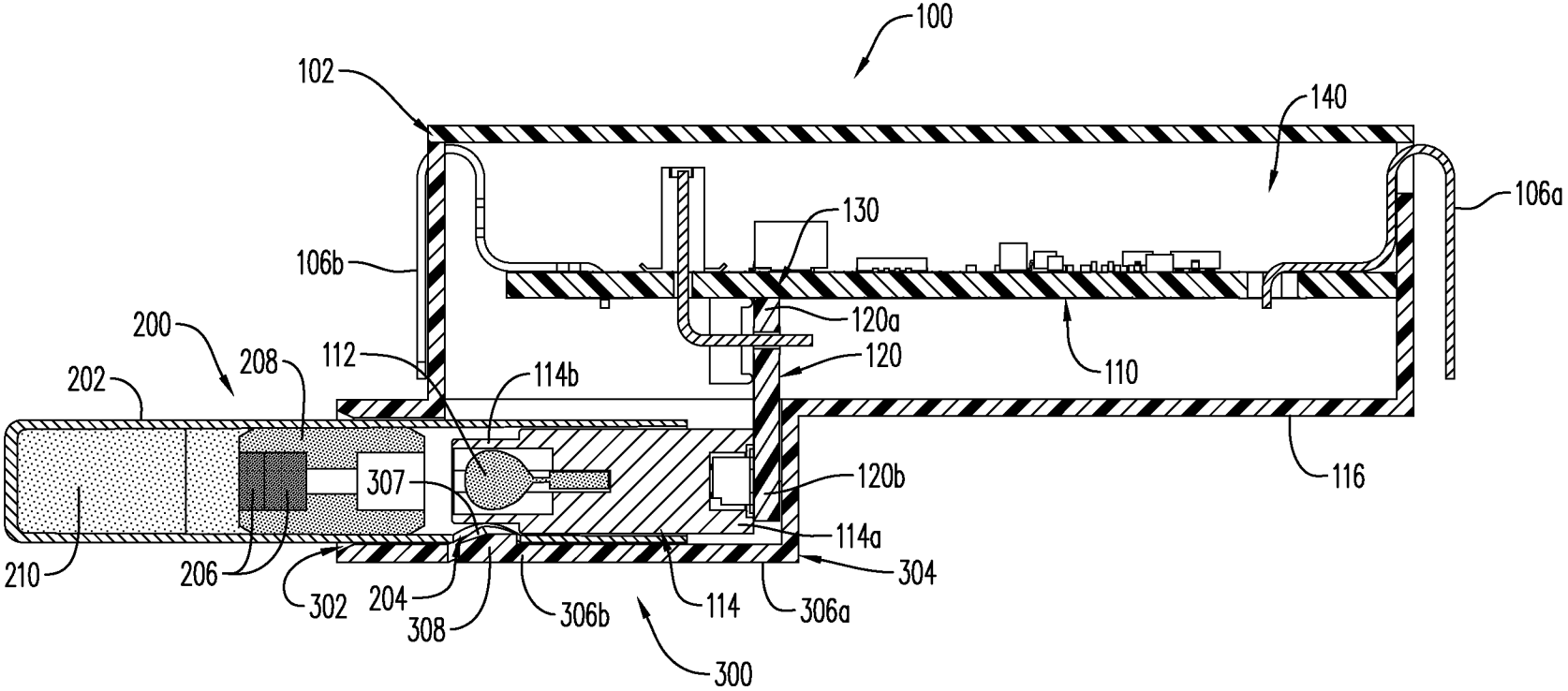
FIG. 2*a* is a longitudinal cross-sectional view illustrating the detonator according to FIG. 1.
Figure 2B:
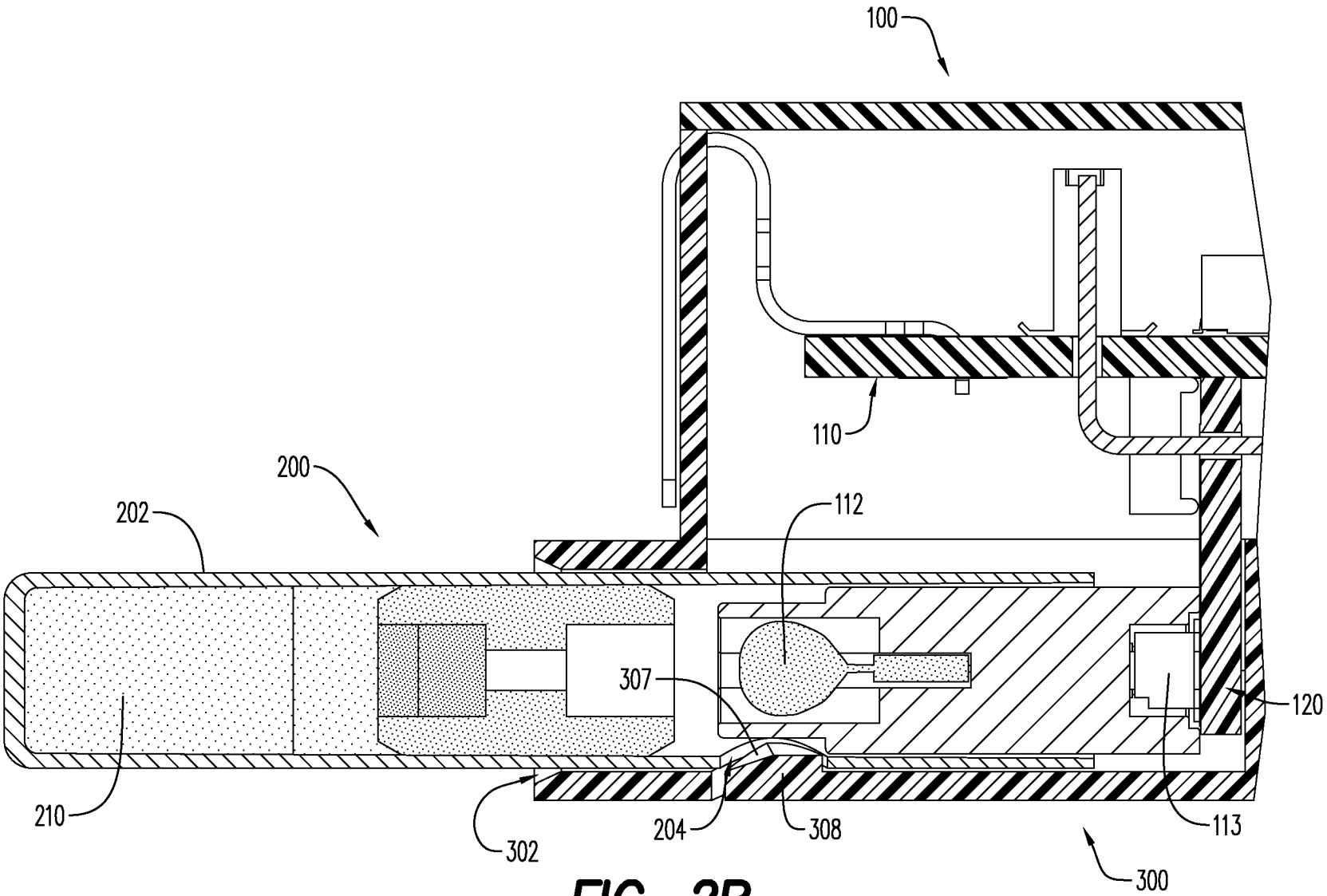
FIG. 2*b* is an enlarged view of a distal end portion of the detonator of FIG. 2*a* including the detonating capsule received within an appendage of the detonator housing.

With reference to FIGS. 1, 2*a*, and 2*b*, the detonator 100 includes a secondary housing or an appendage 300 extending distally from an end portion or a bottom 116 of the housing 102. The appendage 300 may extend distally from a distal end portion (which may be a part of the end portion 116) of the housing 102 and may be monolithically formed with the housing 102 or otherwise coupled to the housing 102. It is contemplated that the appendage 300 may be formed with or otherwise coupled to other suitable locations of the housing 102. The appendage 300 defines a longitudinally-extending channel 302 configured for slidable receipt of the detonating capsule 200. The appendage 300 includes a body portion 304 that defines the channel 302, and a retaining arm 306 movably coupled to the body portion 304. The body portion 304 may have a cylindrical shape, but other suitable shapes are contemplated, such as, for example, rectangular. The arm 306 may be formed as a cutout of body portion 304. As such, the body portion 304 and the arm 306 collectively define a cutout or gap 310 therebetween. The gap 310 may be configured to allow a fluid to enter the channel 302 of the body portion 304.

As seen for instance in FIG. 2*a*, the arm 306 of the appendage 300 has a proximal end portion 306*a* formed with the body portion 304, and a free distal end portion 306*b*. The proximal end portion 306*a* of the arm 306 is configured to flex or bend relative to the body portion 304 to move the distal end portion 306*b* of the arm 306 between a first position and a second position. In other aspects, the proximal end portion 306*a* of the arm 306 may be pivotably coupled to the body portion 304 via a hinge. The distal end portion 306*b* of the arm 306 has a protuberance or tab 308 extending inwardly from an inner surface of the arm 306. The tab 308 is configured to form a snap-fit or interference fit with a correspondingly-shaped opening 204 defined in the detonating capsule 200. The tab 308 may have a chamfered surface 307 configured to assist with flexing of the arm 306 during axial insertion of the detonating capsule 200 into the channel 302.

When the retaining arm 306 of the appendage 300 is moved toward a flexed position (e.g., the first position, not explicitly shown), for example, due to the axial insertion of the detonating capsule 200 into the channel 302, the distal end portion 306*b* of the arm 306 and the tab 308 thereof are positioned outside of the channel 302 of the body portion 304 to permit the full insertion of the detonating capsule 200 into the channel 302. When the arm 306 is an unflexed position (e.g., the second position, as shown in FIG. 2*a*), the tab 308 extends into the channel 302 to engage or be positioned in at least a portion of the opening 204 defined in the detonating capsule 200 to selectively lock the detonating capsule 200 in the channel 302. It is contemplated that the arm 306 may be resiliently biased toward the second position. When the tab 308 is captured in the opening 204, removal of the detonating capsule 200 from the channel 200 is prevented.

With continued reference to FIGS. 1, 2*a*, and 2*b*, the detonating capsule 200 includes a casing or outer shell 202 and a primary explosive 206 and a secondary explosive 210 received in the outer shell 202. The outer shell 202 defines a recess, hole or opening 204 formed in the outer shell 202. According to an aspect, the opening 204 is configured as a through hole that connects areas external to the detonating capsule 200 with the interior of the detonating capsule 200, such that it is an inflow point for fluids. As such, fluid external to the detonator 100 may flow through the gap 310 (FIG. 1) of the appendage 300 and into contact with the fuse head 112 of the detonating capsule 200 via the opening 204 in the outer shell 202 of the detonating capsule 200. When fluid contacts the fuse head 112, the detonator 100 is disabled. In aspects, fluid may flow through a longitudinal space defined between the body portion 204 and the outer shell 202 and ultimately into contact with a second circuit board 120 of the electronic printed circuit board 130 to disable the electrical connection between the electronic printed circuit board 130 and the detonating capsule 200.

The primary explosive load 206 of the detonating capsule 200 is usually more sensitive to pressure or friction. Therefore, the primary explosive 206 is often supported by a metallic holder that protects it from mechanical influences. The secondary explosive 210 is usually a less sensitive explosive that is initiated by the primary explosive 206. The amount of secondary explosive 210 in a detonator is much higher than the primary explosive 206. According to an aspect, the primary explosive load 206 is positioned in a holder or a non-mass explosive (NME) body 208. A socket/fuse head housing 114 is disposed in the detonating capsule 200 in a spaced apart relation to the NME body 208. The fuse head housing 114 has a first end portion 114*a* and a second end portion 114*b*. An electrical component, such as, for example, the second printed circuit board 120 is secured to the first end portion 114*a* of the fuse head housing 114. The fuse head 112 is secured to the second end portion 114*b* of the fuse head housing 114.

During assembly, the detonating capsule 200 may be axially inserted into the channel 302 of the appendage 300, whereby the first end portion 114*a* of the fuse head housing 114 engages the chamfer 307 of the tab 308 to move the distal end portion 306*b* of the retaining arm 306 and the tab 308 thereof out of the insertion path of the detonating capsule 200. Upon the detonating capsule 200 being fully inserted into the channel 302, represented by an electrical component 113 (FIG. 2*b*) of the fuse head 112 connecting with the second printed circuit board 120, the opening 204 in the outer shell 202 of the detonating capsule 200 receives the tab 308 to lock the detonating capsule 200 in the channel 302 of the appendage 300.

Figure 3:
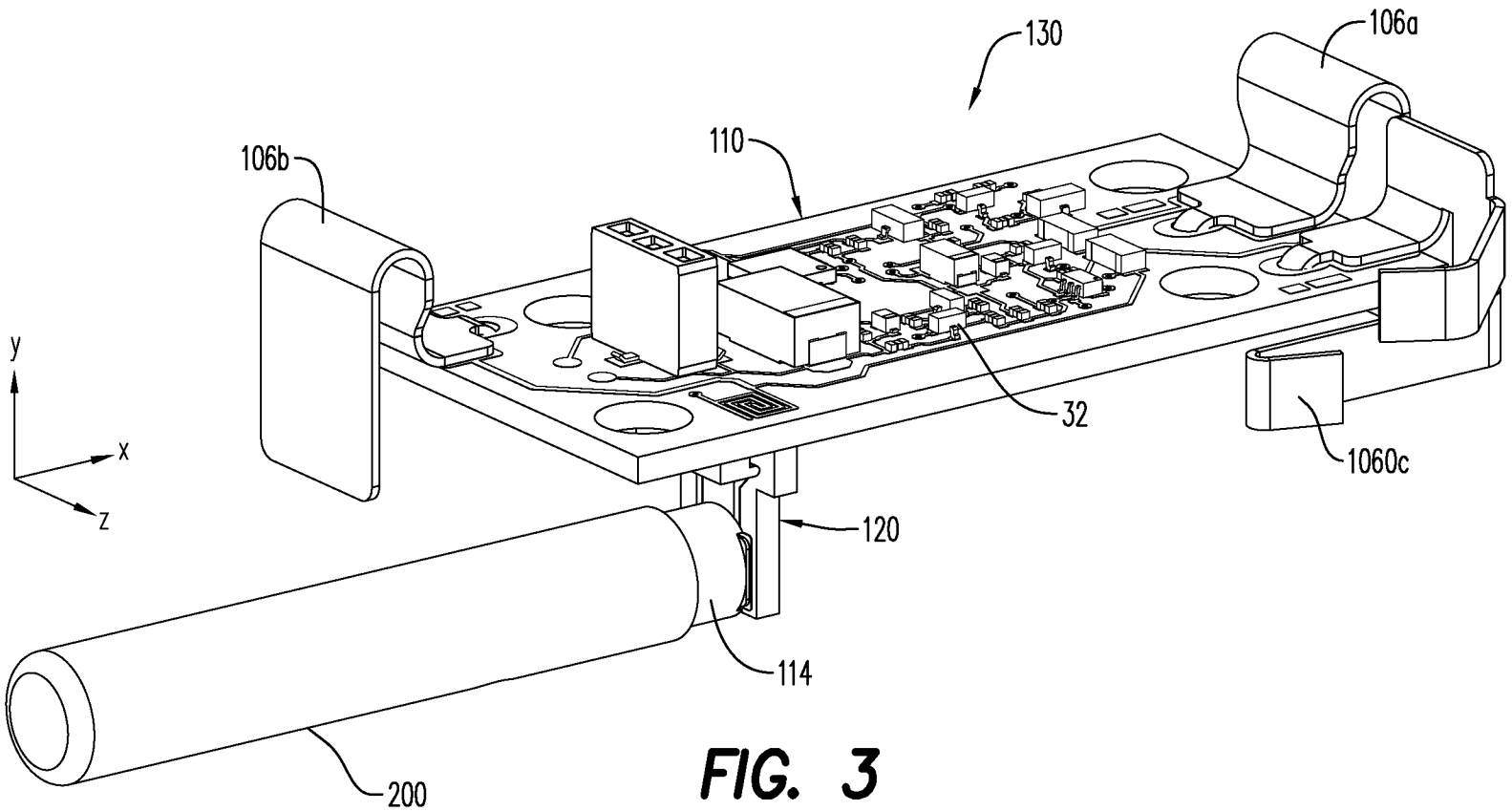
FIG. 3 is a top perspective view of the detonator of FIG. 2*a*, with the detonator housing removed, illustrating a multidimensional electronic circuit board attached to the detonating capsule.
Figure 4:
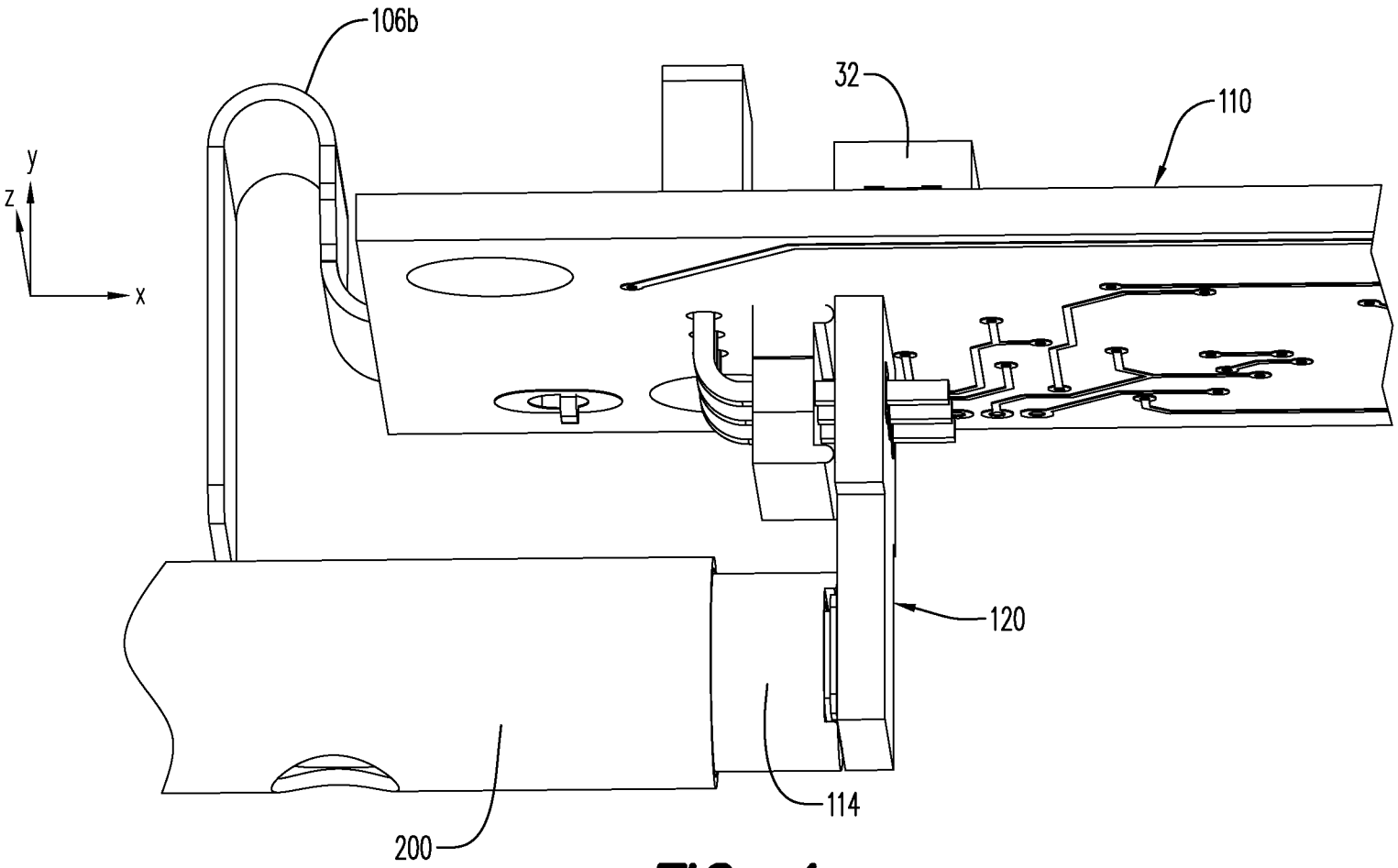
FIG. 4 is a bottom perspective view illustrating a distal end portion of the electronic circuit board and a proximal end portion of the detonating capsule of FIG. 3.

With reference to FIGS. 1, 2*a*, 3, and 4 the multidimensional printed circuit board 130 in this disclosure is also referred as an electronic initiation board ("EIB")— the EIB 130 hosts an initiation circuit. FIGS. 1, 2*a*, and 3 also illustrate electrical contact plates 106*a*, 106*b* that extend from opposing ends of a first printed circuit board or printed circuit board portion 110 of the EIB 130. Each of the contact plates 106*a*, 106*b* may be exposed to an environment external to the detonator housing 102. The use of the electrical contact plates 106*a*, 106*b* facilitates a wire-free connection between other electrical contacts/contact plates or surfaces within a tool string, such as, for example, a string of perforating gun assemblies. In other words, through the use of the contact plates 106*a*, 106*b* and a ground contact plate 106*c*, the detonator 100 can be referred to as a wireless detonator, as it has no wired connections to ground, and has no wired in-line or out-line contact.

Figure 5A:
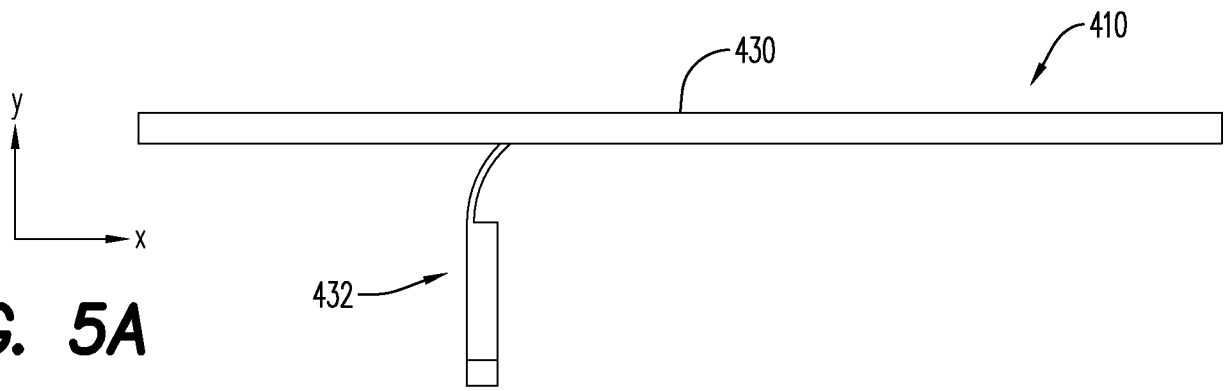
FIG. 5*a* is a side view of another aspect of a multidimensional electronic circuit board configured for receipt in the detonator housing of FIG. 1.
Figure 5B:
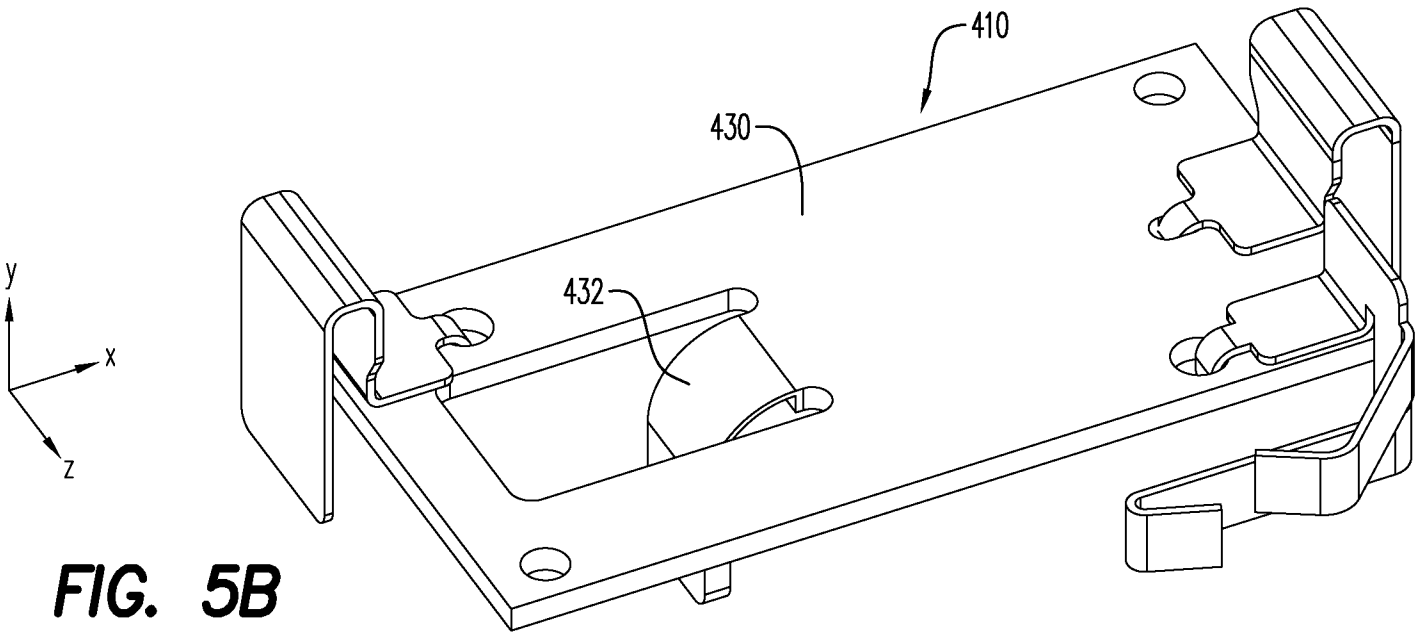
FIG. 5*b* is a top perspective view of the multidimensional electronic circuit board of FIG. 5*a;*

The multidimensional printed circuit board 130 includes the first printed circuit board 110 and the second printed circuit board or printed circuit board portion 120, which is coupled to and extending perpendicularly from the first printed circuit board 110. The first printed circuit board 110 further includes electronic components 32, which may be electrical circuits, logic circuits, data processors, capacitors, resistors or even measuring devices for example accelerometers, gravimeters, or thermometers. The second printed circuit board 120 may connect to the first printed circuit board 110 via a plug-in connection. According to an aspect, as shown in FIGS. 5*a* and 5*b*, the second printed circuit board 120 may be a partially stamped-out portion of the first printed circuit board 110, which is then bent so that the second printed circuit board 120 extends in a direction that is generally perpendicular to the first printed circuit board 110. The second printed circuit board 120 extends from within the inner chamber 140 of the detonator housing 102 and into the channel 302 of the appendage 300 for engagement with the first end portion 114*a* of the fuse head housing 114 of the detonating capsule 200 when the detonating capsule 200 is received in the appendage 300. It is contemplated that the detonating capsule 200 is configured to electromechanically couple to the first printed circuit board 110 via the second printed circuit board 120.

With reference to FIGS. 5*a* and 5*b*, another multidimensional printed circuit board 410 is provided, similar to the multidimensional printed circuit board 110 of FIG. 3. The multidimensional printed circuit board 410 may be used in the detonator 100 of FIG. 1 in place of the multidimensional printed circuit board 130. The multidimensional printed circuit board 410 includes a main body portion 430 configured for receipt in the chamber 140 (FIG. 2*a*) of the housing 102, and a strap or bent portion 432 extending from the main body portion 430. The bent portion 432 is configured for receipt in the channel 302 (FIG. 2*a*) of the appendage 300 and to detachably couple to the detonating capsule 200. The bent portion 432 is formed with and bent (e.g., at a 90 degree angle) from the main body portion 430. An electrical initiation signal may be communicated from the main body portion 430 and to the detonating capsule 200 via the bent portion 432.

Figure 6B:
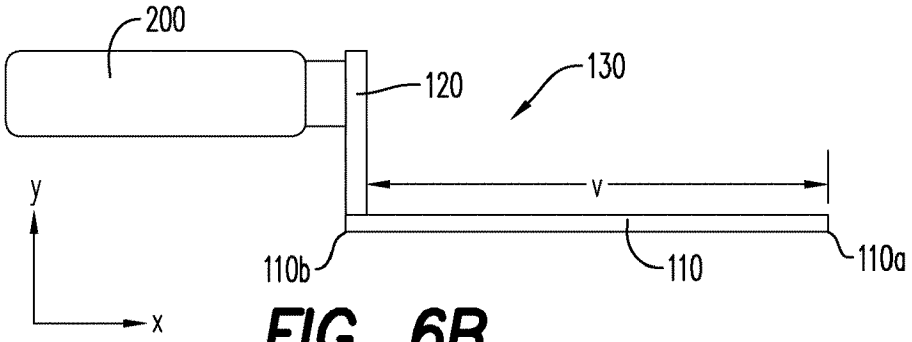
FIG. 6*b* is a side view of yet another aspect of a multidimensional electronic circuit board attached to a detonating capsule.
Figure 6A:
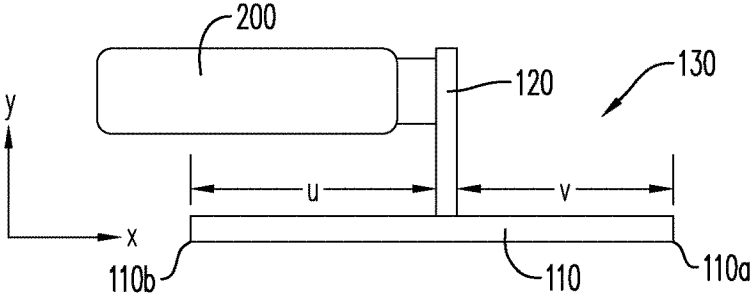
FIG. 6*a* is a side view of another aspect of a multidimensional electronic circuit board attached to a detonating capsule.
Figure 6C:
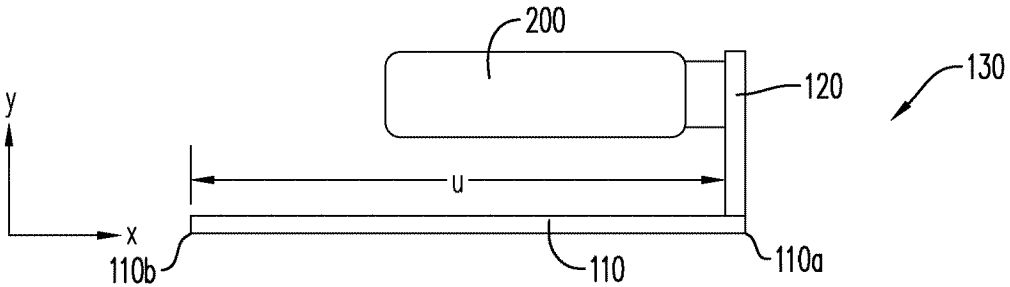
FIG. 6*c* is a side view of yet another aspect of a multidimensional electronic circuit board attached to a detonating capsule.

FIGS. 6*a*-6*c* show various alternate arrangements and dimensions of different portions of an EIB 130. FIGS. 6*a*, 6*b* and 6*c* show the arrangement of the second printed circuit board 120 of the EIB 130 in relation to the first printed circuit board 110 of the EIB 130. The detonating capsule 200 in these exemplary embodiments is mounted to the second printed circuit board 120. In FIG. 6*a*, the second printed circuit board 120 may connect to a location of the first printed circuit board 110 between opposing first and second ends 110*a*, 110*b* of the first printed circuit board 110. For example, the second printed circuit board 120 may connect to the first printed circuit board 110 at a central location of the first printed circuit board 110, such that distances of u and v are equal.

Turning now to FIG. 6*b*, the connection of the second printed circuit board 120 to the first printed circuit board 110 is at the second end 110*b* of the first printed circuit board 110. Alternatively, as shown in FIG. 6*c*, the connection of the second printed circuit board 120 to the first printed circuit board 110 may be at the first end 110*a* of the first printed circuit board 110. Other connection positions in between the first and second ends 110*a*, 110*b* are contemplated herein.

Figure 7A:
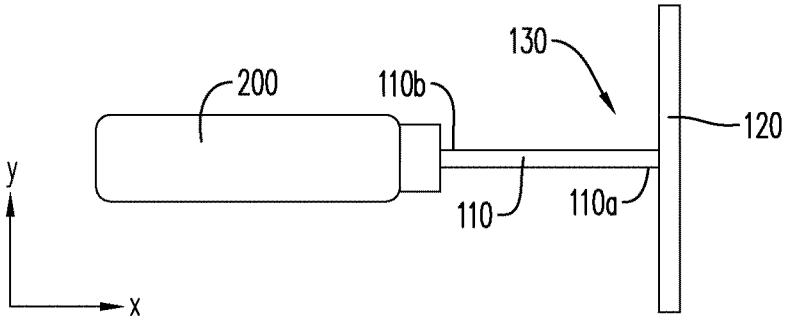
FIG. 7*a* is a side view of yet another aspect of a multidimensional electronic circuit board attached to a detonating capsule.

FIGS. 7*a*, 7*b*, 7*c* and 7*d* show different shapes and configurations of an EIB 130 with respect to the detonating capsule 200. In FIG. 7*a*, the detonating capsule 200 is shown mounted to a second end 110*b* of the first printed circuit board 110*a* and extending coaxially therewith. A first end 110*a* of the first printed circuit board 110 is coupled to and extending perpendicularly from a central location of the second printed circuit board 120.

Figure 7B:
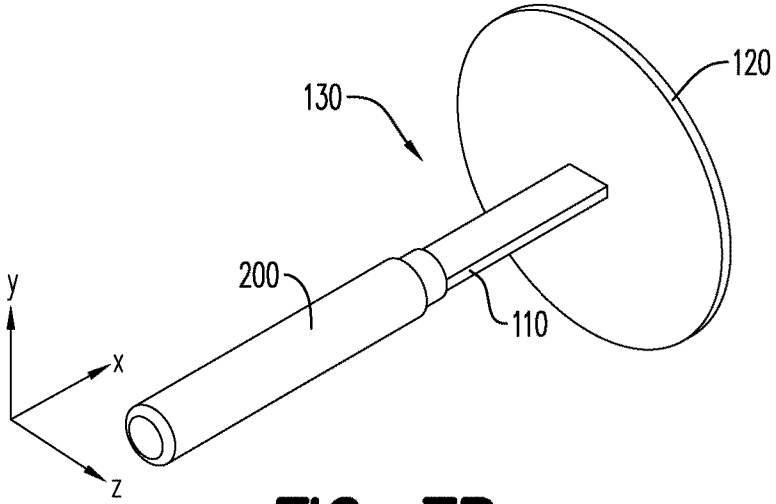
FIG. 7*b* is a perspective view of yet another aspect of a multidimensional electronic circuit board attached to a detonating capsule.
Figure 7C:
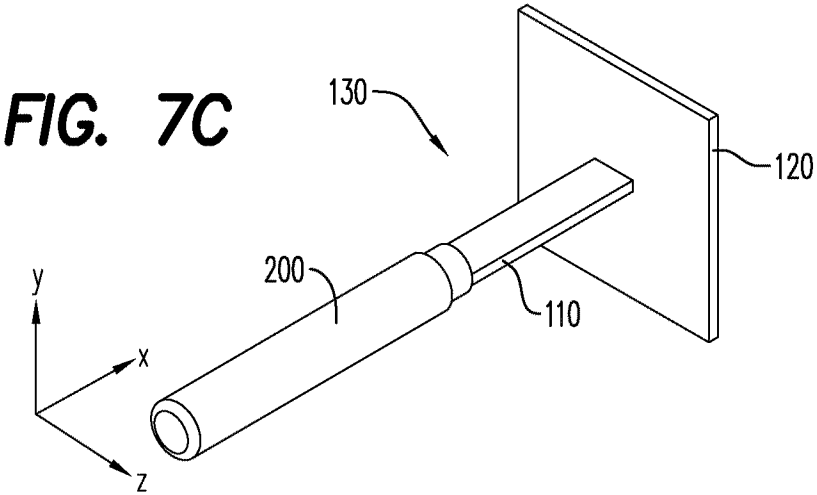
FIG. 7*c* is a perspective view of the multidimensional electronic circuit board of FIG. 7*a* attached to a detonating capsule.
Figure 7D:
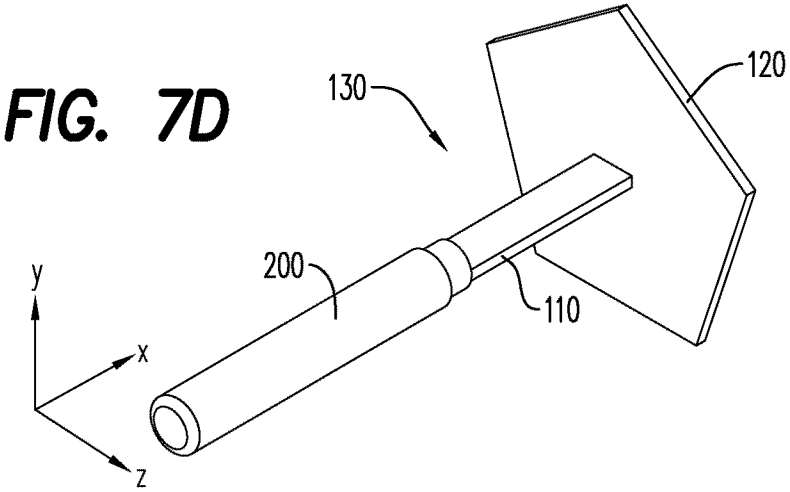
FIG. 7*d* is a perspective view of yet another aspect of a multidimensional electronic circuit board attached to a detonating capsule.

FIGS. 7*b*, 7*c* and 7*d* are perspective views of the EIB 130 with the configuration shown in FIG. 7*a*. In FIG. 7*b*, the second printed circuit board 120 extends in the y-z plane and has a round shape. In FIG. 7*c*, the second printed circuit board 120 extends in the y-z plane and has a rectangular shape. In FIG. 7*d*, the second printed circuit board 120 extends in the y-z plane and has a polygonal shape. Other shapes and configurations for the EIB 130 are also contemplated.

Figure 8A:
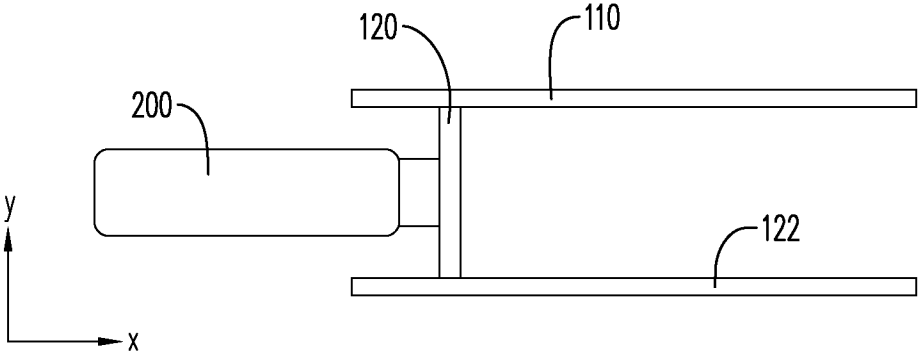
FIG. 8*a* is a side view of yet another aspect of a multidimensional electronic circuit board attached to a detonating capsule.

FIGS. 8*a*, 8*b*, 8*c*, and 8*d* illustrate different exemplary embodiments of a multidimensional EIB 130 having more than two printed circuit boards. FIG. 8*a* shows a detonating capsule 200 attached to an EIB 130 having a first printed circuit board 110, a second printed circuit board 120, and a third printed circuit board 122. The first and third printed circuit boards 110, 122 extend in parallel relation to one another. The second printed circuit board 120 extends between and interconnects the first and third printed circuit boards 110, 122. The second printed circuit board 120 may be coupled to end portions of the first and third printed circuit boards 110, 122 such that the EIB 130 assumes a generally U-shaped cross-section. The detonating capsule 200 may be coupled to and extend perpendicularly from the second printed circuit board 200.

Figure 8B:
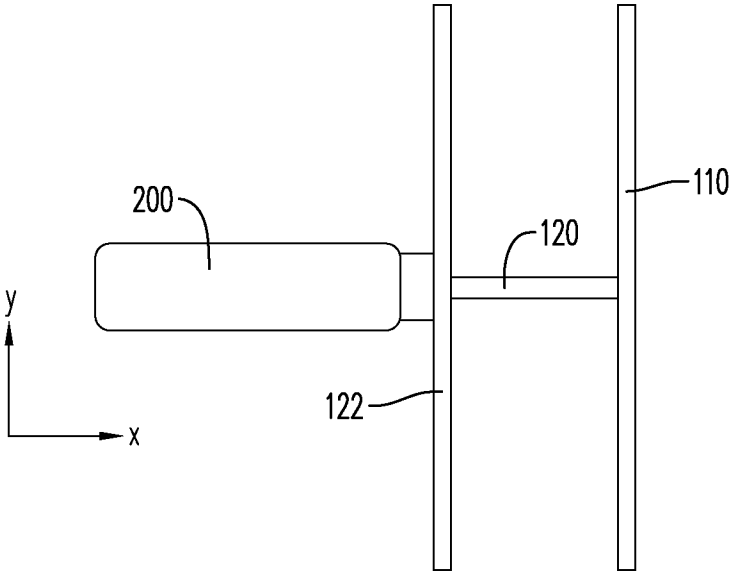
FIG. 8*b* is a side view of yet another aspect of a multidimensional electronic circuit board attached to a detonating capsule.

In FIG. 8*b*, the second printed circuit board 120 extends between and interconnects the first and third printed circuit boards 110, 122, but is coupled between central portions of the first and third printed circuit boards 110, 122 such that the EIB 130 assumes a generally H-shaped cross-section. Further, the detonating capsule 200 may be coupled to and extend perpendicularly from the third printed circuit board 122. As such, the EIBs 130 of FIGS. 8*a* and 8*b* provide more surface area on which to mount electronic components in the compact space of a detonator housing 102.

Figure 8C:
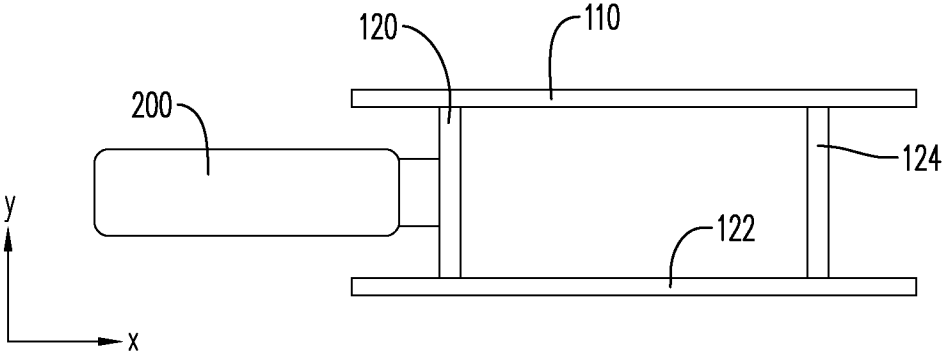
FIG. 8*c* is a side view of yet another aspect of a multidimensional electronic circuit board attached to a detonating capsule.
Figure 8D:
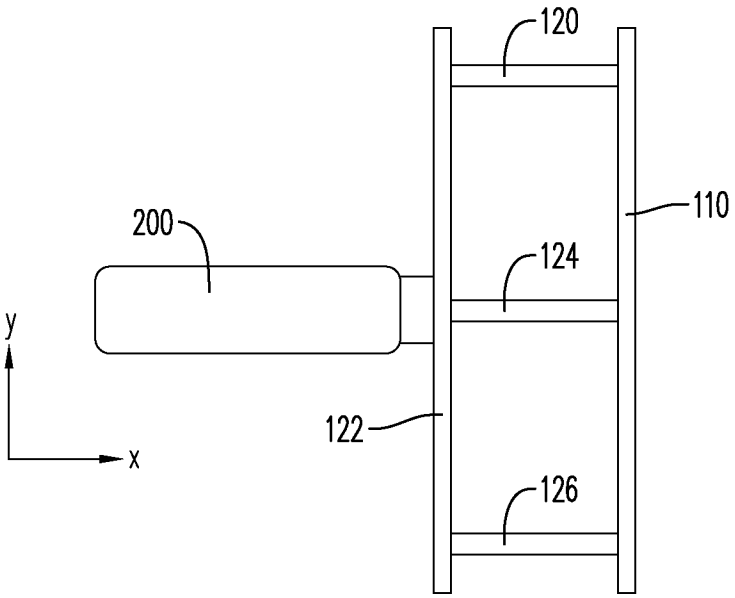
FIG. 8*d* is a side view of yet another aspect of a multidimensional electronic circuit board attached to a detonating capsule.

In FIGS. 8*c* and 8*d*, more variants of a multidimensional EIB having more than three printed circuit boards is shown. The EIB 130 in FIG. 8*c* is similar to the EIB 130 of FIG. 8*a* except the EIB 130 of FIG. 8*c* has a fourth printed circuit board 124 spaced from and aligned with the second printed circuit board 120. The EIB 130 in FIG. 8*d* is similar to the EIB 130 of FIG. 8*c* except the EIB 130 of FIG. 8*d* has a fifth printed circuit board 126 spaced from and aligned with the second and fourth printed circuit boards 120, 124. Additional portions may be connected to the same EIB in order to improve the structural strength and integrity of the circuit board.

FIGS. 9-14 show different embodiments of a detonator 100, which may have similar features as those described hereinabove. As such, only selected features of the detonator 100 of FIGS. 9-14 will be described in detail.

Figure 9:
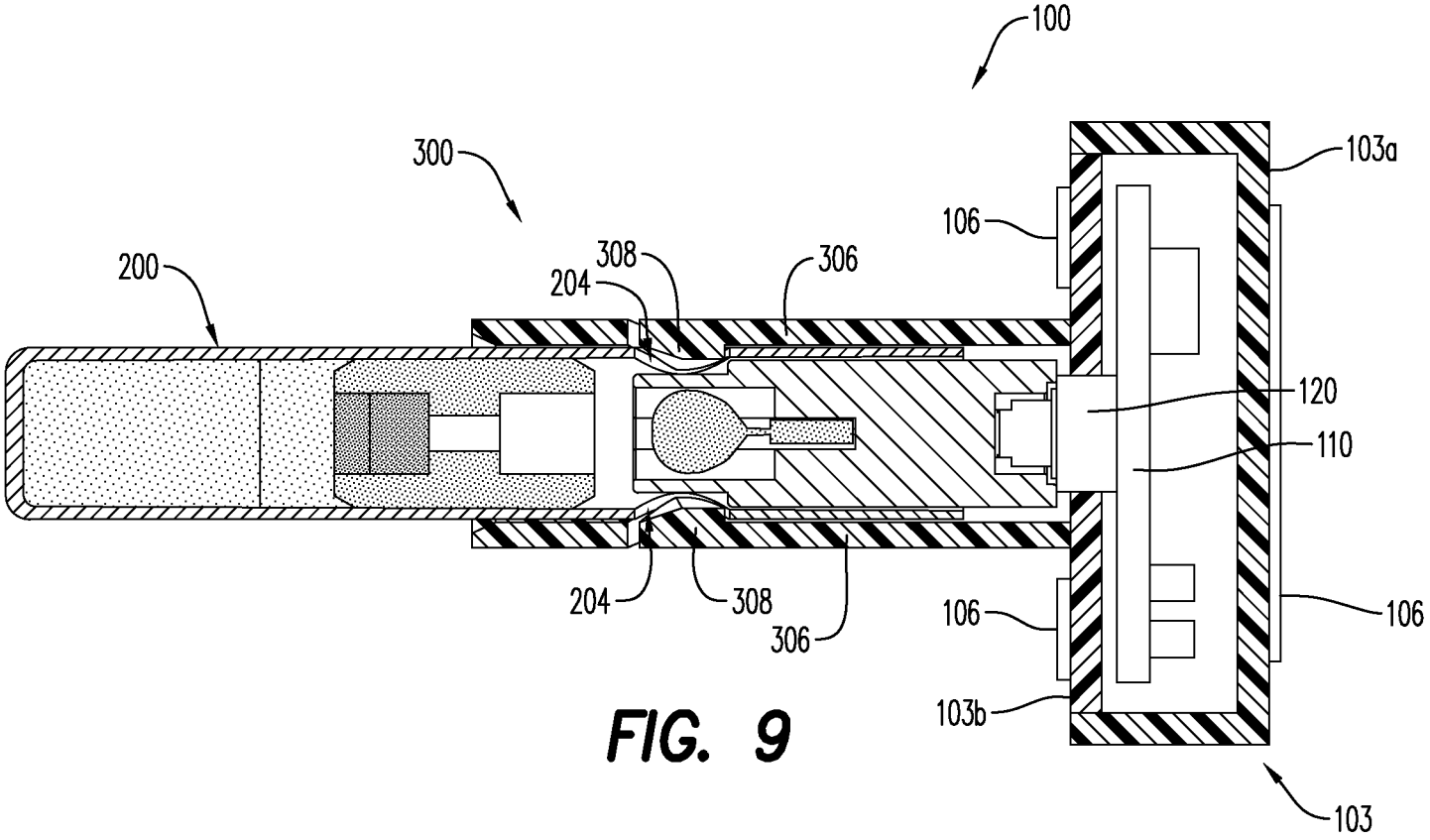
FIG. 9 is a longitudinal cross-sectional view illustrating another aspect of a detonator including a detonator housing, a multidimensional printed circuit board received in the detonator housing, and a detonating capsule attached to the multidimensional printed circuit board.

In FIG. 9, a detonator 100 is displayed that has a wireless detonator head 103 with electrical contacts 106 at both a top surface 103*a* and a bottom surface 103*b* of the detonator head 103. In the configuration of FIG. 9, the electronics of the detonator 100, for example, the first and second printed circuit boards 110, 120, are located inside the detonator head 103. In this exemplary embodiment, an appendage 300 extends perpendicularly from the bottom surface 103*b* of the detonator head 103 and includes a pair of opposing retaining arms 306 configured to selectively lock the detonating capsule 200 in the appendage 300. The detonator capsule 200 of the present embodiment defines a pair of opposed openings 204 configured for a snap-fit engagement with respective tabs 308 of the retaining arms 306.

Figure 10:
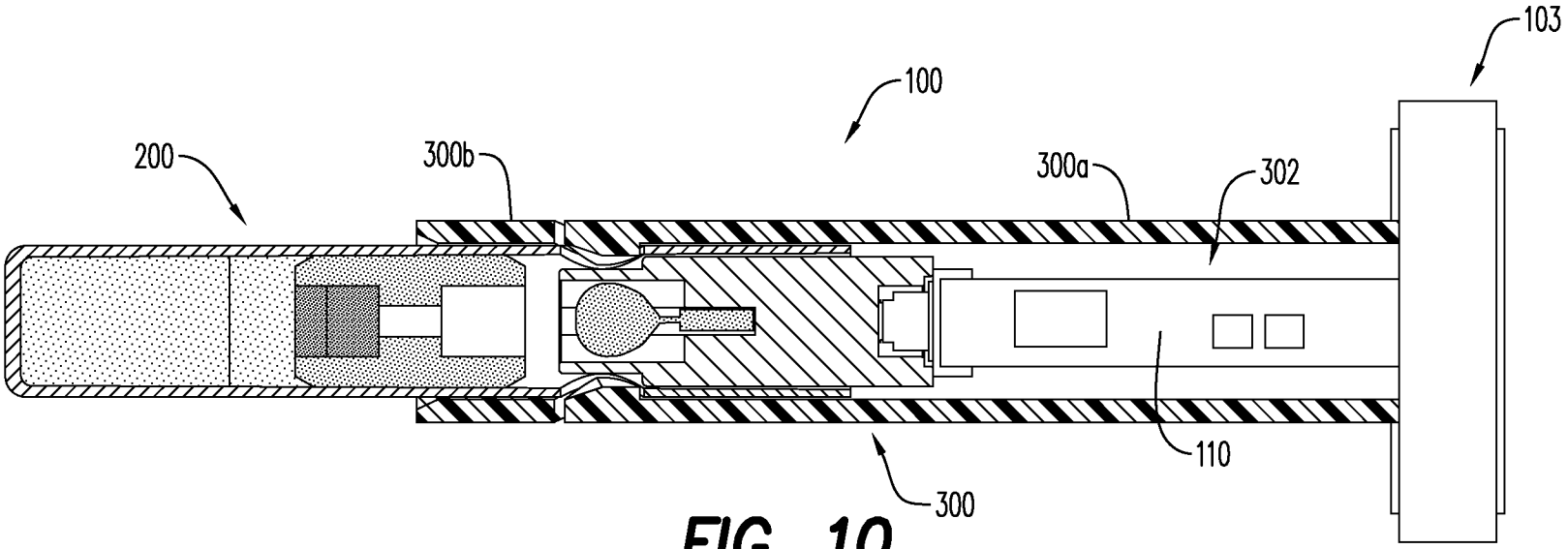
FIG. 10 is a longitudinal cross-sectional view illustrating yet another aspect of a detonator including wireless electrical contacts.

With reference to FIG. 10, a detonator 100 is provided, similar to the detonator 100 of FIG. 9. The detonator 100 of FIG. 10 includes a wireless detonator head 103 and a hollow column or appendage 300 extending perpendicularly from the detonator head 103. The appendage 300 may be longer than the appendages 300 of the previous embodiments and has a proximal end portion 300*a* coupled to the detonator head 103, and a distal end portion 300*b* extending from the proximal end portion 300*a*. In aspects, the proximal and distal end portions 300*a*, 300*b* may be integrally formed with one another or separate components that are coupled to one another. The proximal and distal end portions 300*a*, 300*b* each define a continuous channel 302 therethrough. The proximal end portion 300*a* houses a printed circuit board 110 therein, and the distal end portion 300*b* is configured for receipt of a detonating capsule 200. When the detonating capsule 200 is received in the distal end portion 300*b* of the appendage 300, the detonating capsule and the printed circuit board 110 are longitudinally aligned with one another.

Figure 11:
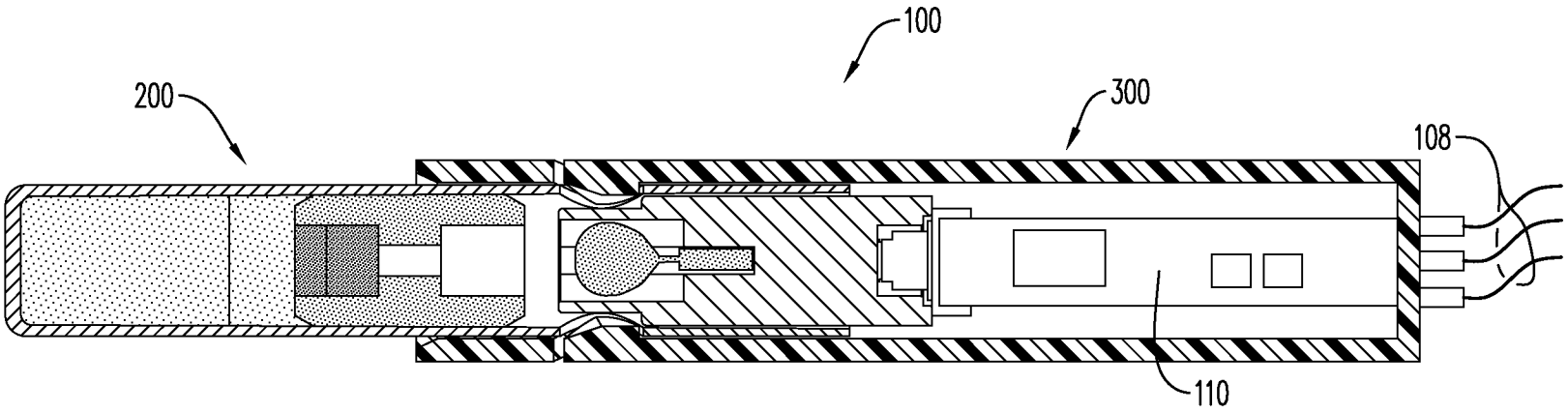
FIG. 11 is a longitudinal cross-sectional view illustrating yet another aspect of a detonator including a wire connection.

With reference to FIG. 11, another embodiment of a detonator 100 is provided, similar to the detonator 100 of FIG. 10. The detonator 100 of FIG. 11 includes an elongated housing 300 or tube having stored therein a printed circuit board 110, and a detonating capsule 200 configured for receipt in the elongated housing 300. In contrast to FIG. 10, instead of having a detonator head, the detonator 100 has wires 108 extending proximally from the elongated housing 300 for receiving a detonating signal. The wires 108 may be three wires, such as, for example, a first wire for an inline signal, a second wire for a ground contact, and a third wire functioning as a feedthrough wire. The wires 108 are configured for use with detonating systems having multiple detonators for multiple initiations.

Figure 12:
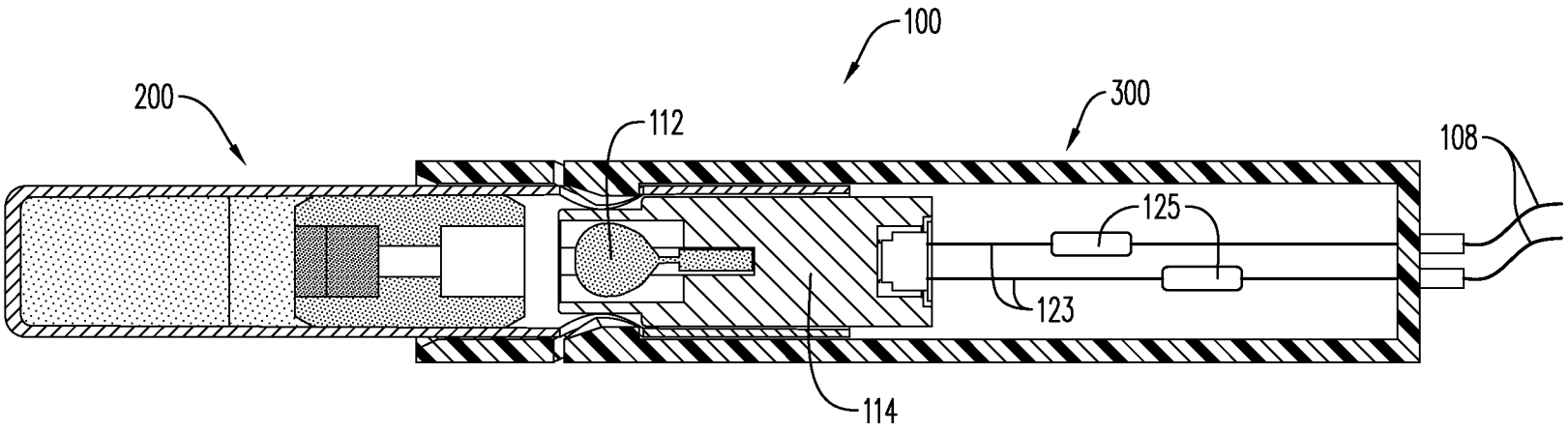
FIG. 12 is a longitudinal cross-sectional view illustrating yet another aspect of a detonator including wires instead of a printed circuit board.

With reference to FIG. 12, another embodiment of a detonator 100 is provided, similar to the detonator 100 of FIG. 11. However, instead of having a printed circuit board that receives a current through the wires 108, the detonator 100 of FIG. 12 includes a pair of cables 123 each having a resistor 125 that may function as a safety mechanism against unintended initiations.

Figure 13:
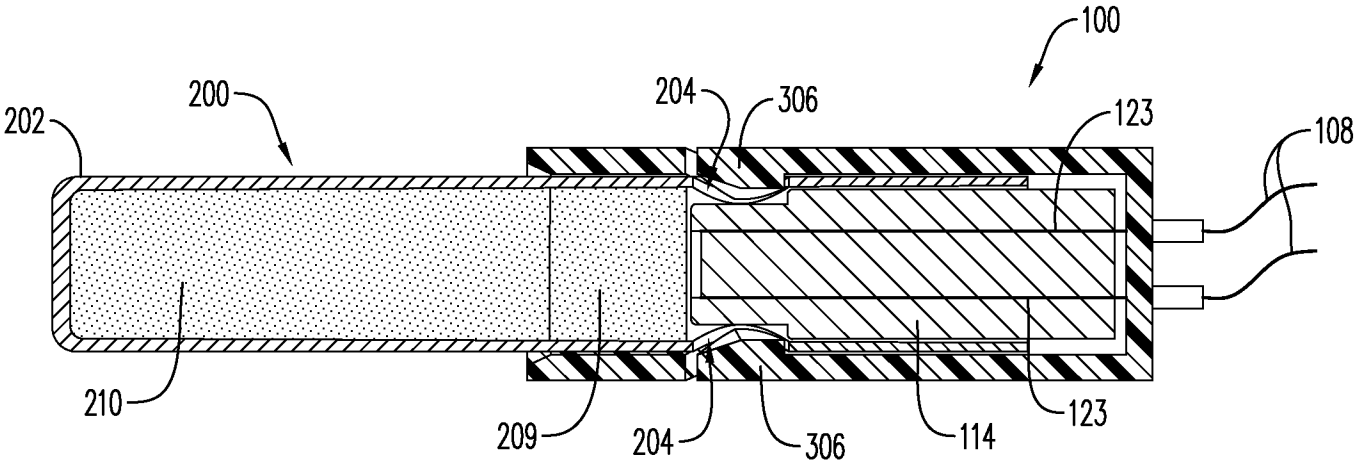
FIG. 13 is a longitudinal cross-sectional view illustrating yet another aspect of a detonator including two retaining arms, a bridge wire, and a detonating capsule.
Figure 14:
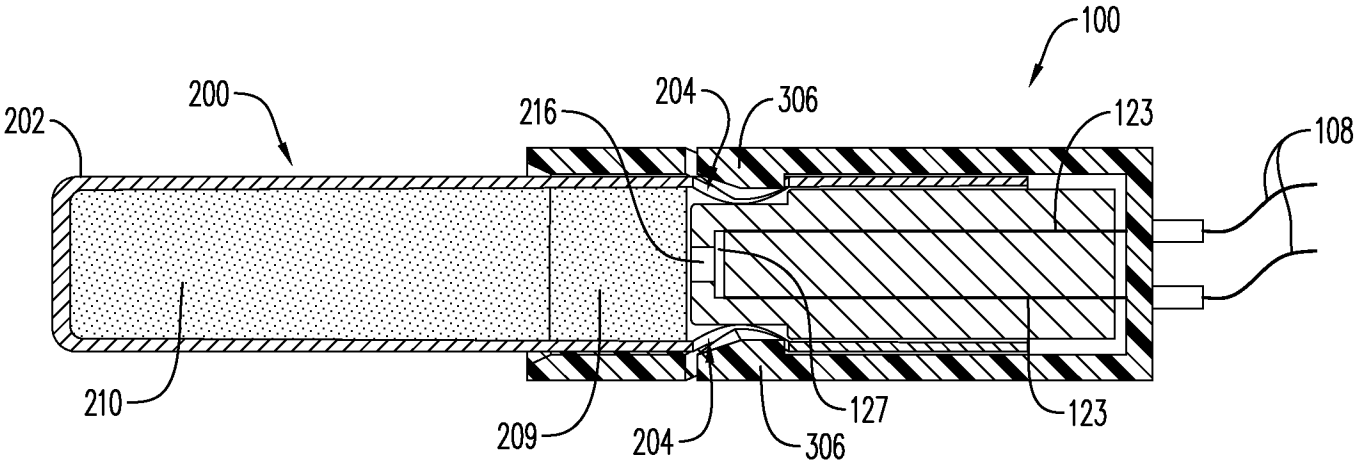
FIG. 14 is a longitudinal cross-sectional view illustrating yet another aspect of a detonator including two retaining arms, an exploding foil initiator, and a detonating capsule.

Alternate initiating mechanisms for the detonators described in above are illustrated in FIGS. 13 and 14—helping to illustrate, at least in part, that this disclosure is not limited to an initiation with a fuse head. FIG. 13 illustrates an embodiment in which a bridge wire 123 is utilized. The bridge wire 123 extends through a fuse head housing 114 and electrically couples the wires 108 and the primary explosive 209. The bridge wire 123 is configured to explode under a high current and creates a shock wave which initiates the insensitive primary explosives 209 of the detonator. Due to the high impact shock from the exploding bridge wire, only insensitive primary explosives are needed. There is no need for a high sensitive explosive, for example, lead azide, or silver azide. This initiation method is commonly known as an exploding bridge wire ("EBW").

Similar to a bridge wire is an exploding foil initiator ("EFI"), which is displayed in FIG. 14. In the embodiment of FIG. 14, a foil 127 is connected to two wires 123. With a high current, through these wires the foil 127 explodes and the shock wave moves from the foil through a gap 216, and initiates the adjacent insensitive primary explosives 209 on impact.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A detonator, comprising:

a housing;

a first printed circuit board supported in the housing;

an appendage extending from the housing and defining a channel, the appendage having a tab; and a detonating capsule configured for receipt in the channel of the appendage, wherein the detonating capsule defines an opening configured to be selectively engaged by the tab to retain the detonating capsule in the channel of the appendage;

wherein the first printed circuit board includes:

a main body portion; and a bent portion extending from the main body portion, the bent portion configured to detachably couple to the detonating capsule and is received in the channel of the appendage.

2. The detonator according to claim 1, wherein the appendage includes:

a body portion that defines the channel; and an arm movably coupled to the body portion, the tab extending from a distal end portion of the arm and into the channel.

3. The detonator according to claim 2, wherein the arm has a proximal end portion formed with the body portion and configured to flex relative to body portion between a first position, in which the detonating capsule is receivable into the channel, and a second position, in which the tab is received in the opening of the detonating capsule.

4. The detonator according to claim 2, wherein the body portion and the arm collectively define a gap therebetween, the gap being configured to allow a fluid to enter the opening of the detonating capsule to disable the detonator.

5. The detonator according to claim 4, wherein the detonating capsule includes:

an outer shell that defines the opening therein; and a fuse head received in the outer shell, the fuse head being in fluid communication with an external environment via the opening.

6. The detonator according to claim 1, further comprising a second printed circuit board having a first end portion coupled to or extending from the first printed circuit board and being received within the housing, and a second end portion configured to detachably couple to the detonating capsule and being received in the channel of the appendage.

7. The detonator according to claim 6, wherein the first and second printed circuit boards mare perpendicular to one another.

8. The detonator according to claim 1, wherein the housing defines a longitudinal axis, and the appendage defines longitudinal axis that is parallel with the longitudinal axis of the housing.

9. The detonator according to claim 8, wherein the appendage is coupled to a bottom portion of the housing.

10. A detonator, comprising:

a housing defining an inner chamber;

a printed circuit board supported in the inner chamber of the housing;

an appendage including:

a body portion extending from the housing and defining a longitudinally-extending channel;

a retaining arm having a proximal end portion movably coupled to the body portion; and a tab extending from a free, distal end portion of the retaining arm; and a detonating capsule configured for receipt in the channel of the body portion, wherein the detonating capsule defines an opening configured to be selectively engaged by the tab to retain the detonating capsule in the channel of the body portion.

11. The detonator according to claim 10, wherein the proximal end portion of the retaining arm is formed with the body portion and is configured to flex relative to the body portion between a first position, in which the detonating capsule is receivable into the channel, and a second position, in which the tab is received in the opening of the detonating capsule.

12. The detonator according to claim 11, wherein the body portion and the retaining arm define a gap therebetween configured to allow a fluid to enter the opening of the detonating capsule.

13. The detonator according to claim 12, wherein the detonating capsule includes:

an outer shell that defines the opening therein; and a fuse head received in the outer shell, the fuse head being in fluid communication with an external environment via the opening.

14. The detonator according to claim 10, wherein the detonating capsule is offset from the housing.

15. A detonator, comprising:

a housing;

a printed circuit board including:

a first portion supported in the housing; and a second portion extending from the first portion;

a body portion extending from the housing and defining a longitudinally-extending channel configured for receipt of a detonating capsule; and a retaining arm having a proximal end portion movably coupled to the body portion, and a free, distal end portion having a tab, wherein the tab is configured for receipt in an opening of a detonating capsule.

16. The detonator according to claim 15, wherein the second portion of the printed circuit board extends perpendicularly from the first portion of the printed circuit board.

17. The detonator according to claim 15, wherein the second portion of the printed circuit board is formed with or coupled to the first portion of the printed circuit board.

18. The detonator according to claim 15, wherein the proximal end portion of the retaining arm is formed with the body portion and configured to flex relative to the body portion between a first position, in which the tab is positioned outside of the channel and a second position, in which the tab extends into the channel.

19. The detonator according to claim 15, wherein the body portion and the retaining arm define a gap therebetween configured to allow a fluid to enter the channel.

* * * * *